US009644342B1

(12) United States Patent
Meyers

(10) Patent No.: US 9,644,342 B1
(45) Date of Patent: May 9, 2017

(54) SCREENING BUCKET SYSTEM

(71) Applicant: David J. Meyers, Aberdeen, SD (US)

(72) Inventor: David J. Meyers, Aberdeen, SD (US)

( * ) Notice: Subject to any disclaimer, the term of this patent is extended or adjusted under 35 U.S.C. 154(b) by 0 days.

(21) Appl. No.: 14/975,020

(22) Filed: Dec. 18, 2015

(51) Int. Cl.

| | |
|---|---|
| ***B07B 1/34*** | (2006.01) |
| ***E02F 7/06*** | (2006.01) |
| ***B07B 1/00*** | (2006.01) |
| ***E02F 3/40*** | (2006.01) |

(52) U.S. Cl.
CPC ..... *E02F 7/06* (2013.01); *B07B 1/005* (2013.01); *B07B 1/343* (2013.01); *E02F 3/40* (2013.01)

(58) Field of Classification Search
CPC .. B07B 1/005; B07B 1/343; E02F 7/00; E02F 3/40
USPC ..... 209/335, 348
See application file for complete search history.

(56) References Cited

U.S. PATENT DOCUMENTS

| | | | | |
|---|---|---|---|---|
| 2,764,292 | A * | 9/1956 | Austin, Sr. | B07B 1/005 209/421 |
| 3,072,257 | A * | 1/1963 | Hockenberry | E02F 3/401 171/132 |
| 3,451,575 | A * | 6/1969 | Petro, Jr. | E02F 3/404 414/704 |
| 3,513,584 | A * | 5/1970 | Donner | A01K 97/05 43/56 |
| 3,732,980 | A * | 5/1973 | Evers | E02F 7/06 209/421 |
| 4,157,956 | A * | 6/1979 | Robinson | B07B 1/10 209/260 |
| 4,698,150 | A | 10/1987 | Wigoda | |
| 5,160,034 | A * | 11/1992 | Potter | B07B 1/005 171/135 |
| 5,493,796 | A * | 2/1996 | Ballew | E02F 3/40 209/248 |
| 6,059,119 | A | 5/2000 | Davis | |
| 6,513,664 | B1 | 2/2003 | Logan | |
| 6,988,624 | B2 | 1/2006 | MacNaughton | |
| 7,216,767 | B2 | 5/2007 | Schulte | |
| 7,581,647 | B2 | 9/2009 | Grichar | |
| 8,141,714 | B2 | 3/2012 | Burkhard | |
| 8,893,409 | B1 | 11/2014 | Rossi, Jr. | |
| 2011/0100882 | A1* | 5/2011 | Beam | B07B 1/005 209/252 |

* cited by examiner

*Primary Examiner* — Terrell Matthews
(74) *Attorney, Agent, or Firm* — Neustel Law Offices

(57) ABSTRACT

A screening bucket system for screening debris out of otherwise clean materials. The screening bucket system generally includes a bucket adapted to be connected to a loader. The bucket includes a rear wall, a pair of side walls, and a blade across its front end. A floor of the bucket is hingedly connected at a front end to the side walls by a hinge. The rear end of the floor includes a rod mount to which a lift rod powered by a motor is rotatably connected such that, when the lift rod is raised or lowered, the free end of the floor raises and lowers while the hinged end of the floor rotates about the hinge. A screen may be positioned on the floor such that materials on the screen may be sifted of debris by activating the lift rod to rapidly raise and lower the floor and screen.

18 Claims, 8 Drawing Sheets

SCREENING BUCKET SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to a screening bucket and more specifically it relates to a screening bucket system for efficiently and aggressively screening debris out of otherwise clean materials such as soil, gravel, or sand.

Description of the Related Art

Any discussion of the related art throughout the specification should in no way be considered as an admission that such related art is widely known or forms part of common general knowledge in the field.

The need to sift or screen debris out of a particulate material such as dirt, sand, or gravel is prevalent across a wide range of industries. For example, dirt is often sifted for landscaping work, backfilling trenches, and the like. As a further example, it is often desirable to clean sand on a beach of impurities such as trash or tar balls through sifting the sand.

Previous sifting machines typically utilize rubber to suspend a screen floor. These types of sifting machines cannot shake large loads (such as 1000-1500 lbs) efficiently or aggressively. Loader buckets with solid welded-in screens force the operator to lift and drop the whole loader in order to screen the materials, which can be very tedious due to lack of efficiency and prematurely wear out the loader.

Most sifting machines utilize vibration for sifting of materials. Vibrational sifting machines are inefficient when used with large, heavy, or wet loads of materials. Additionally, high-flow hydraulics are often necessary to support the high speed vibration of the whole machine, which limits the loaders available to power the screen.

Because of the inherent problems with the related art, there is a need for a new and improved screening bucket system for efficiently and aggressively screening debris out of materials such as soil, gravel, or sand.

BRIEF SUMMARY OF THE INVENTION

Provided herein is a screening bucket system which includes a bucket adapted to be connected to a loader. The bucket includes a rear wall, a pair of side walls, and a blade across its front end. A floor of the bucket is hingedly connected at a front end to the side walls by a hinge. The rear end of the floor includes a rod mount to which a lift rod powered by a motor is rotatably connected such that, when the lift rod is raised or lowered, the free end of the floor raises and lowers while the hinged end of the floor rotates about the hinge. A screen may be positioned on the floor such that materials on the screen may be sifted of debris by activating the lift rod to rapidly raise and lower the floor and screen.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
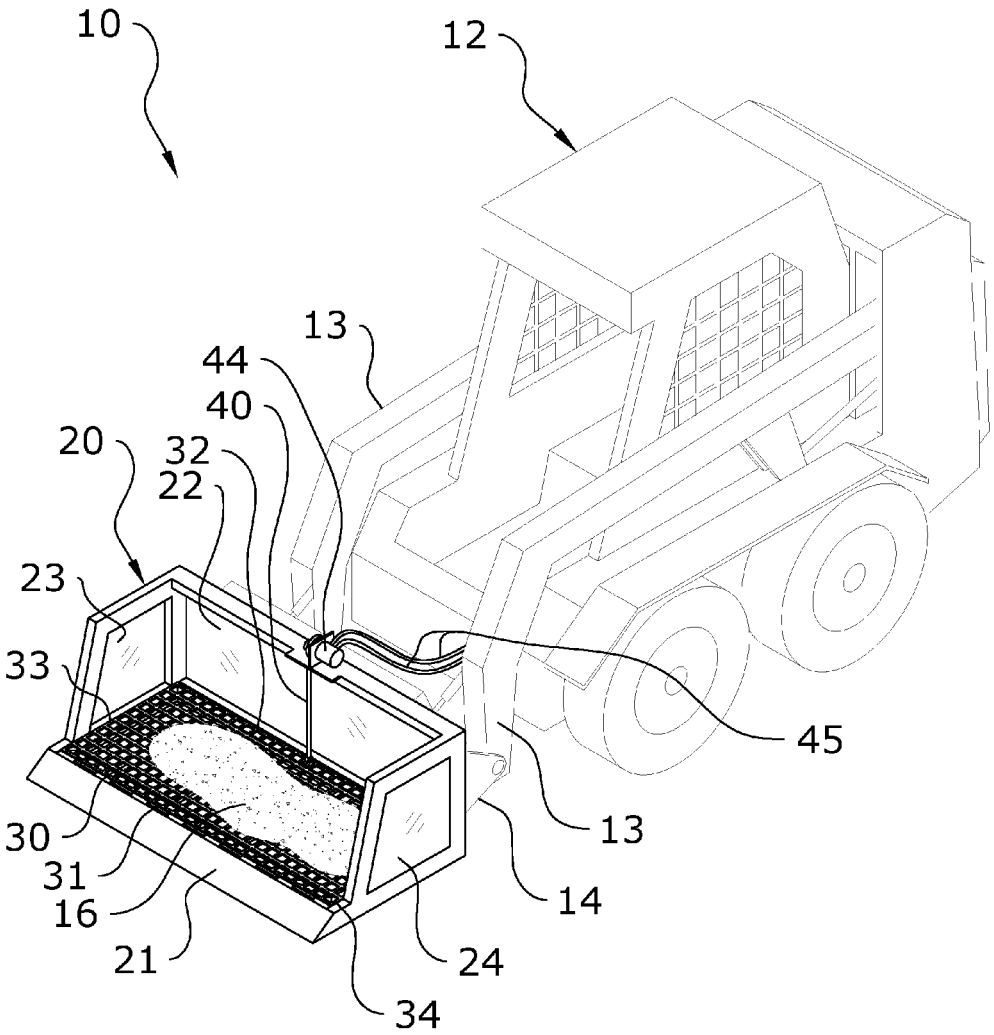
FIG. 1 is an upper perspective view of the present invention installed on a loader.

A. Overview.

Turning now descriptively to the drawings, in which similar reference characters denote similar elements throughout the several views, FIGS. 1 through 12 illustrate a screening bucket system 10, which comprises a bucket 20 adapted to be connected to a loader 12. The bucket 20 includes a rear wall 22, a pair of side walls 23, 24, and a blade 21 across its front end. A floor 25 of the bucket 20 is hingedly connected at a front end to the side walls 23, 24 by a hinge 26. The rear end of the floor 25 includes a rod mount 27 to which a lift rod 40 powered by a motor 44 is rotatably connected such that, when the lift rod 40 is raised or lowered, the free end of the floor 25 raises and lowers while the hinged end of the floor 25 rotates about the hinge 26. A screen 30 may be positioned on the floor 25 such that material 17 on the screen 30 may be sifted of debris 16 by activating the lift rod 40 to rapidly raise and lower the floor 25 and screen 30.

B. Bucket.

Figure 2:
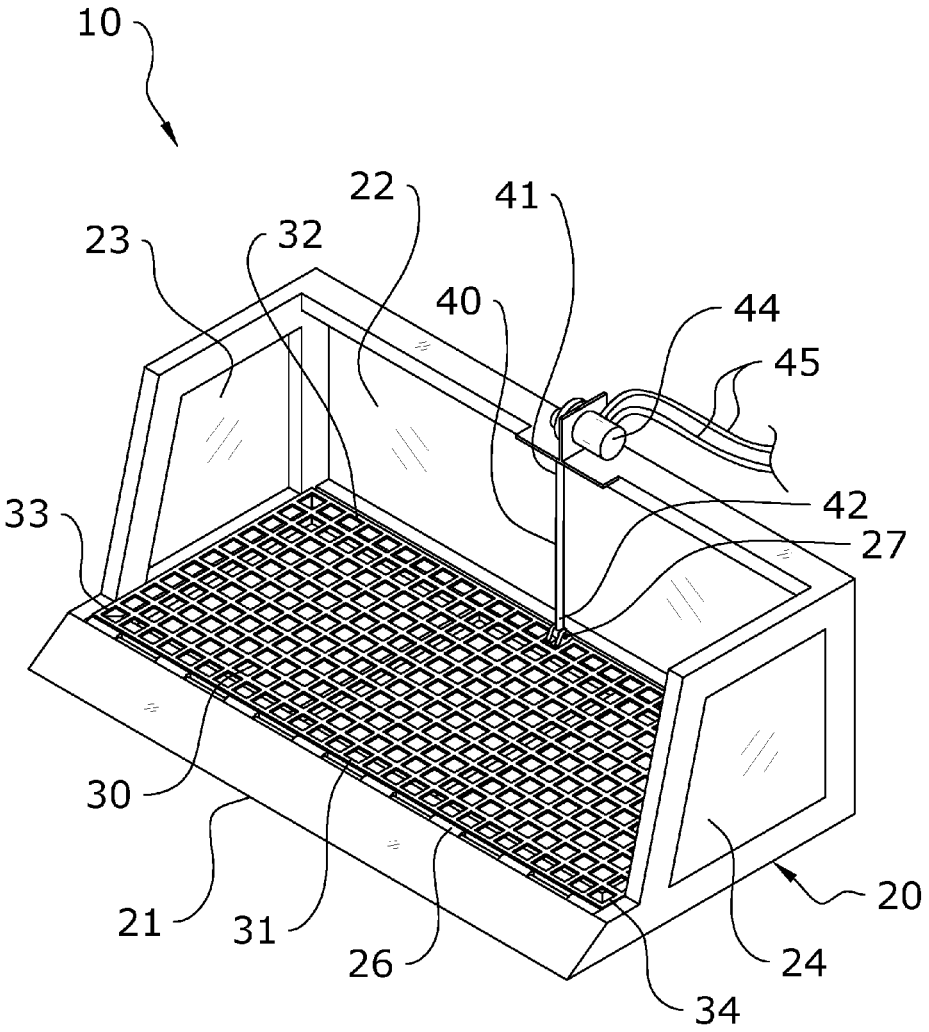
FIG. 2 is an upper perspective view of the present invention.

As shown throughout the figures, the present invention includes a bucket 20 which scoops material 17 to be cleaned of debris 16 by the present invention. The bucket 20 may comprise various configurations and thus should not be construed as limited to the exemplary configuration shown in the figures. In such an exemplary embodiment, the bucket 20 comprises a rear wall 22, a first side wall 23 and a second side wall 24. A blade 21, such as an angle iron or other diagonally-oriented member adapted to scoop material 17 into the bucket 20, extends across the front end of the bucket 20 between the first and second side walls 23, 24 as shown in FIGS. 1 and 2.

The bucket 20 will generally include a floor 25 which is connected between the rear wall 22, side walls 23, 24, and blade 21. In the embodiment shown in FIG. 4, the floor 25 comprises a frame of elongated members which include three distinct openings. It should be appreciated that other types of floors 25 may be utilized. For example, although the present application discusses a discrete screen 30, it should be appreciated that the screen 30 and floor 25 could be integrated (i.e., the floor 25 comprises a screen 30).

Figure 4:
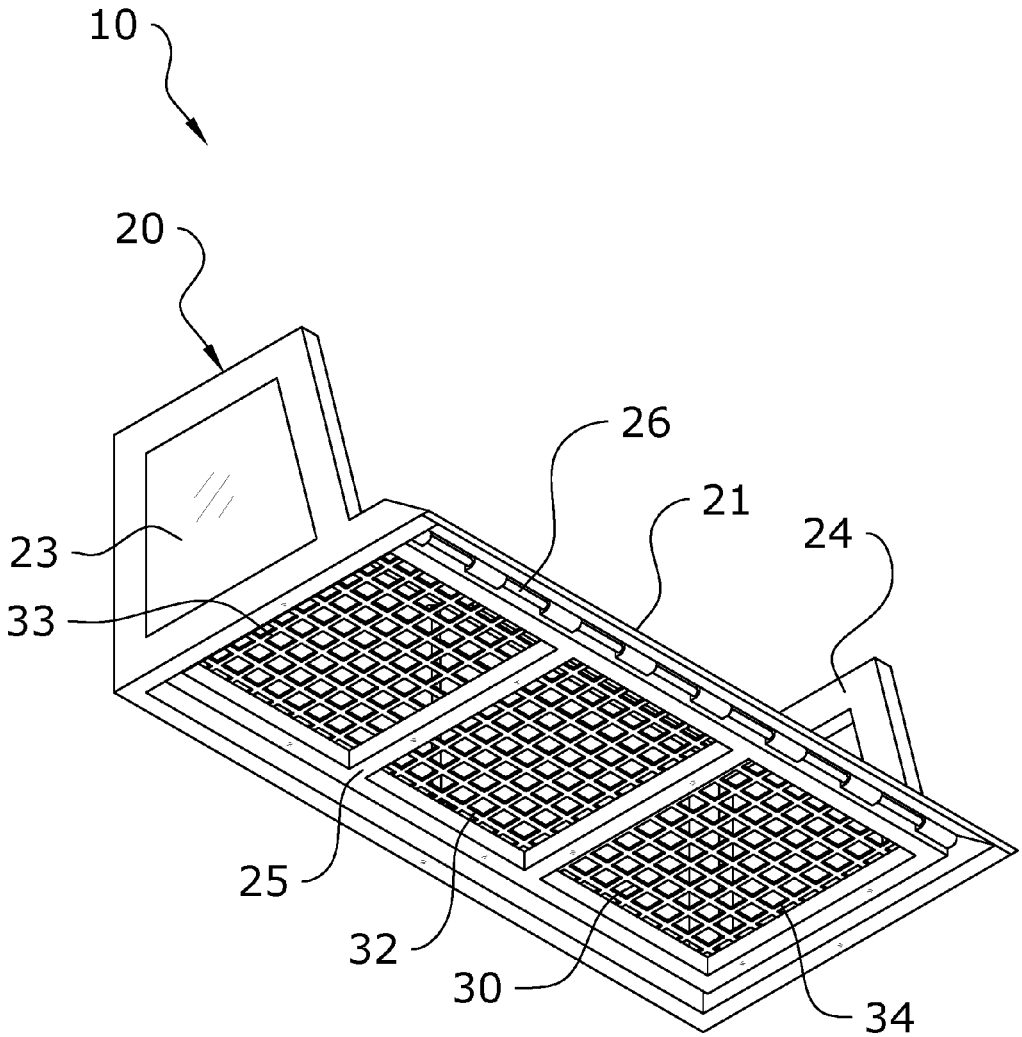
FIG. 4 is a bottom perspective view of the present invention.
Figure 5:
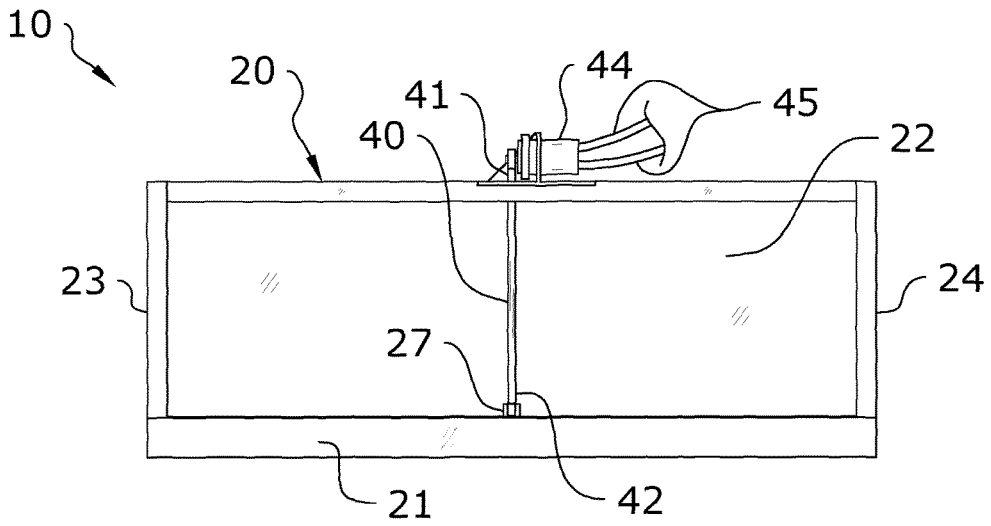
FIG. 5 is a frontal view of the present invention.
Figure 6:
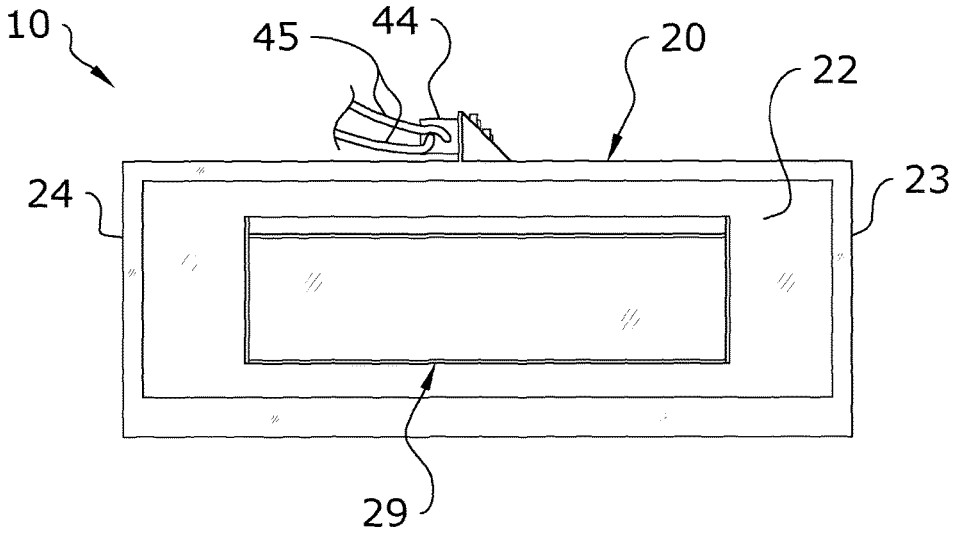
FIG. 6 is a rear view of the present invention.
Figure 7:
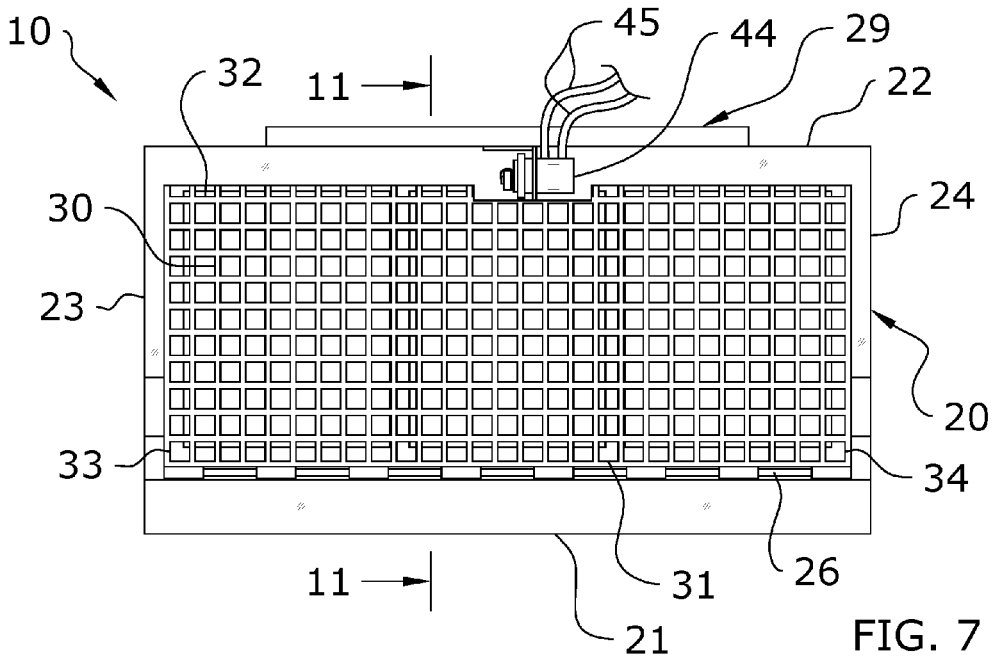
FIG. 7 is a top view of the present invention.
Figure 8:
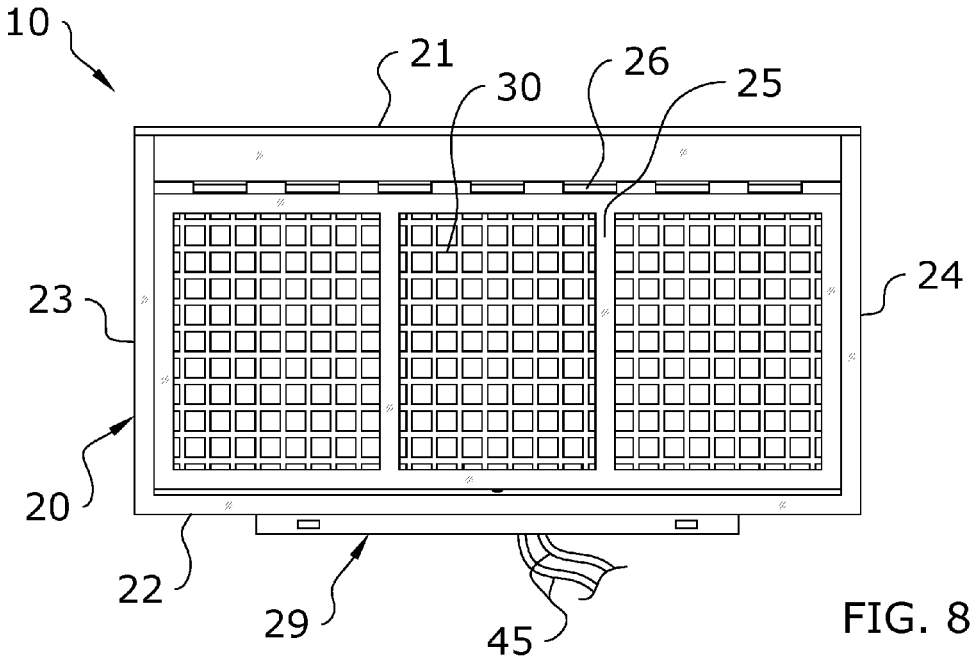
FIG. 8 is a bottom view of the present invention.
Figure 9:
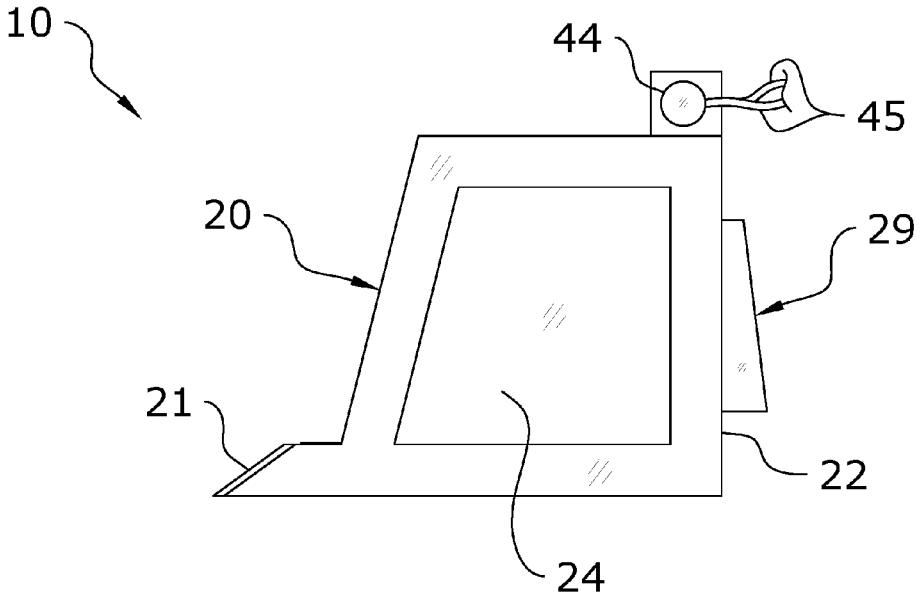
FIG. 9 is a first side view of the present invention.
Figure 10:
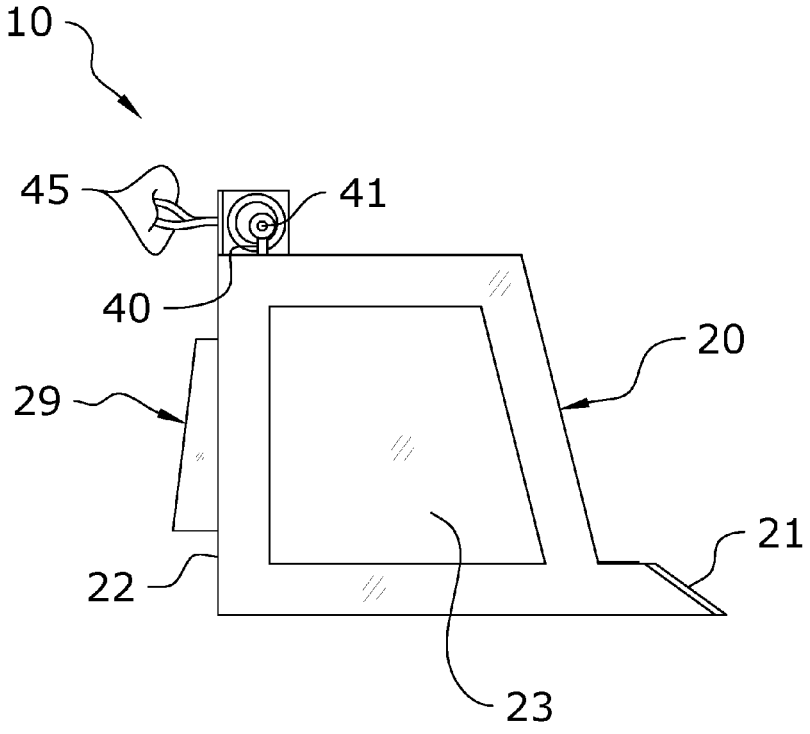
FIG. 10 is a second side view of the present invention.

The floor 25 is preferably hingedly connected on one end to the bucket 20, such as by a hinge 26 as shown in FIG. 4. The floor 25 will preferably be rotatably connected at its hinged end, so that the free end may be rapidly raised and lowered by the lift rod 40. Although the figures illustrate the hinge 26 as being positioned near the front of the bucket 20 (near the blade 21), it should be appreciated that the hinge 26 could be positioned near the rear of the bucket 20 in some embodiments. The hinge 26 will preferably extend between the first and second side walls 23, 24 as shown in the figures. Various types of hinges 26 may be utilized and the present invention should not be construed as limited by the exemplary hinge 26 shown in the figures.

Figure 11:
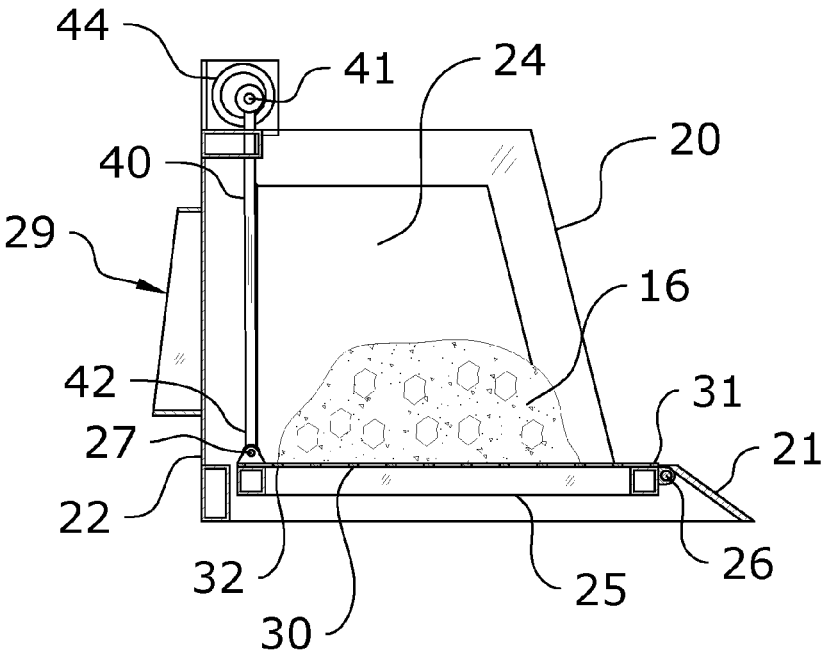
FIG. 11 is a side sectional view of the present invention.

The floor 25 may include a rod mount 27 to which the lift rod 40 is rotatably connected as shown in FIG. 11. The rod mount 27 is generally positioned on the floor 25 between the first and second side walls 23, 24 of the bucket 20. The figures illustrate the rod mount 27 as being centrally located between the side walls 23, 24, but other positioning could be utilized in some embodiments. The rod mount 27 will generally comprise a bracket or loop to which the lift rod 40 may be connected. The lift rod 40 may be fixedly or removably connected to the rod mount 27. In some embodiments, the lift rod 40 may be connected directly to the floor 25 without use of a discrete rod mount 27.

Figure 3:
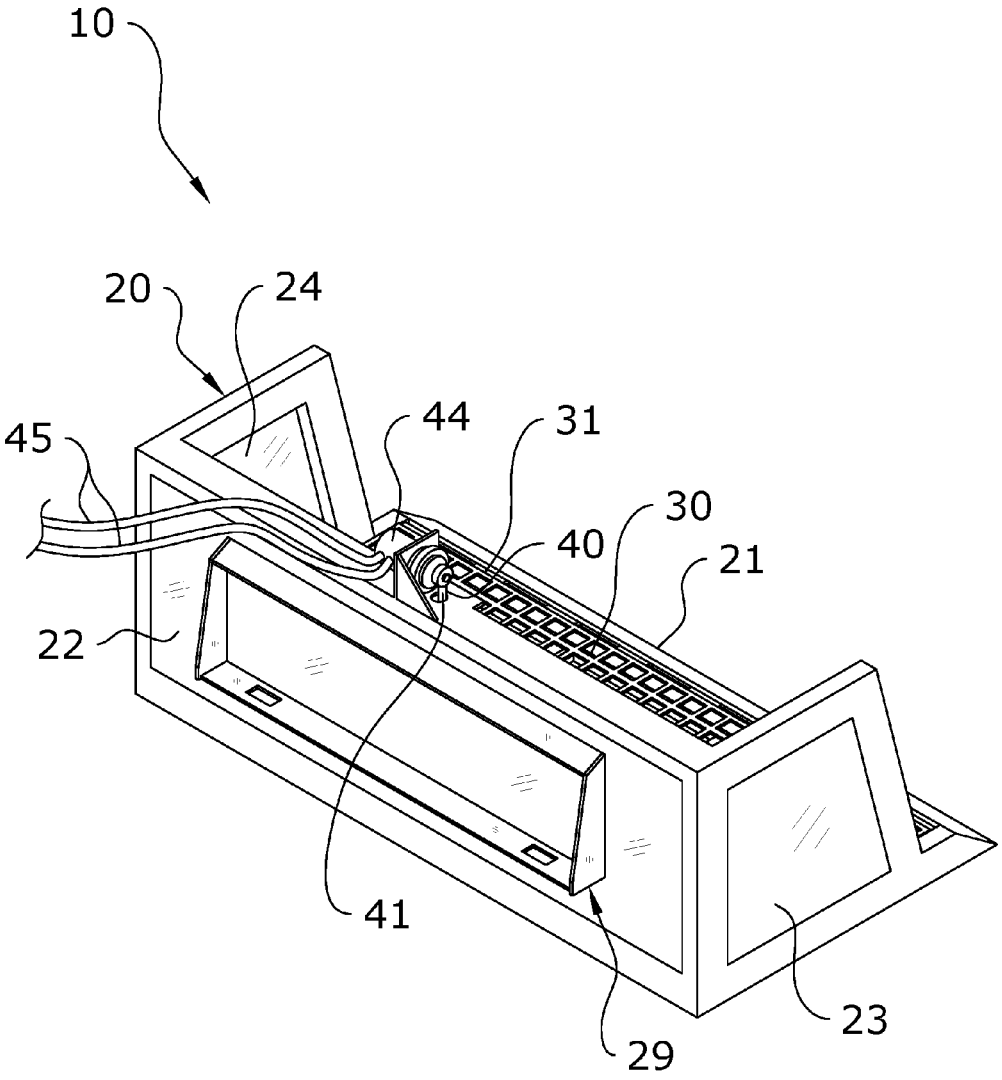
FIG. 3 is a rear perspective view of the present invention.

As shown in FIG. 3, the bucket 20 may include a bucket mount 29 at its rear end. Various types of mounts known to allow a bucket 20 to be removably connected to a loader 12 may be utilized. In a preferred embodiment, the bucket mount 29 comprises a quick-connect bracket to which the arms 13 of the loader 12 may be easily connected.

C. Screen.

As shown throughout the figures, the present invention may utilize a screen 30 to filter debris 16 out of material 17. Various types of screens 30 may be utilized depending on the type of material 17 and/or debris 16 being sifted. Thus, the scope of the present invention should not be limited to the exemplary screen 30 shown in the figures. The screen 30 will generally comprise a front end 31 positioned near the blade 21, a rear end 32 positioned near the rear wall 22, a first side 33 positioned near the first side wall 23, and a second side 34 positioned near the second side wall 24.

The screen 30 may be fixedly attached to the floor 25, may be integrated with the floor 25, or may be removably connected to the floor 25. Preferably, the screen 30 will be removably connected to the floor 25 so that it may be interchangeable. For example, after use of a first screen 30 for a first material 17, the first screen 30 could be easily removed and replaced with a second screen 30 for a second material 17.

The screen 30 comprises a plurality of perforations or openings through which material 17 may fall while retaining debris 16 on top of the screen 30. The size of the perforations or openings will vary depending on what is being sifted. The screen 30 will preferably be approximately the same shape and dimensions as the floor 25, though this may vary in different embodiments.

D. Lift Rod.

As shown in FIG. 11, the present invention may include a lift rod 40 which is adapted to rapidly raise and lower the floor 25 of the bucket 20, thus forcing material 17 through the screen 30 while retaining debris 16 on top of the screen 30. The lift rod 40 comprises an elongated member such as a rod having an upper end 41 and a lower end 42. The upper end 41 of the lift rod 40 is connected to a motor 44 which reciprocates the lift rod 40. The lower end 42 of the lift rod 40 may be rotatably connected to the rod mount 27 or may be directly connected to the floor 25.

The shape, size, and configuration of the lift rod 40 may vary in different embodiments and for different applications. Preferably, the lift rod 40 will comprise a metallic material which is suitable for repeated blunt force impact without warping, breaking, or becoming otherwise structurally compromised. The lift rod 40 may be removably connected between the motor 44 and the floor 25 so as to allow easy replacement or service.

As shown in the figures, the motor 44 is generally positioned on the rear wall 22 of the bucket 20, though other placements may be utilized. Various types of motors 44 may be used to raise and lower the lift rod 40, such as a hydraulic motor, electric motor, gas motor, or the like. Preferably, a reciprocating motor 44 will be utilized, though alternative configurations may be utilized so long as reciprocating motion is provided to the lift rod 40 to rapidly raise and lower the floor 25. Conduits 45 will preferably extend from the motor 44 to the main control units of the loader 12 so that the lift rod 40 may be controlled from the loader 12 itself.

E. Operation of Preferred Embodiment.

In use, the bucket 20 is first connected to the loader 12. The arms 13 of the loader 12 may be positioned near the bucket mount 29 and connected thereto to connect the bucket 20 to the loader 12. Any conduits 45 extending from the motor 44 are also connected to the loader 12 to ensure that the present invention may be operated from the loader 12.

If the screen 30 has not already been installed, the screen 30 may be positioned on the floor 25 of the bucket 20. The screen 30 may be removably connected such as by pins, bolts, or the like. In some embodiments, clamps may be utilized or other devices known to connect one structure to another. In some embodiments, a separate screen 30 is omitted and the floor 25 comprises the screen.

With the screen 30 positioned in the bucket 20, the bucket 20 may be lowered near a mound of materials 16 such as dirt, sand, or the like. The loader 12 may be advanced so that the materials 16 are drawn over the blade 21 and into the bucket 20 to rest on the screen 30. The bucket 20 may then be lifted off the ground in preparation for sifting as shown in FIG. 1.

Figure 12:
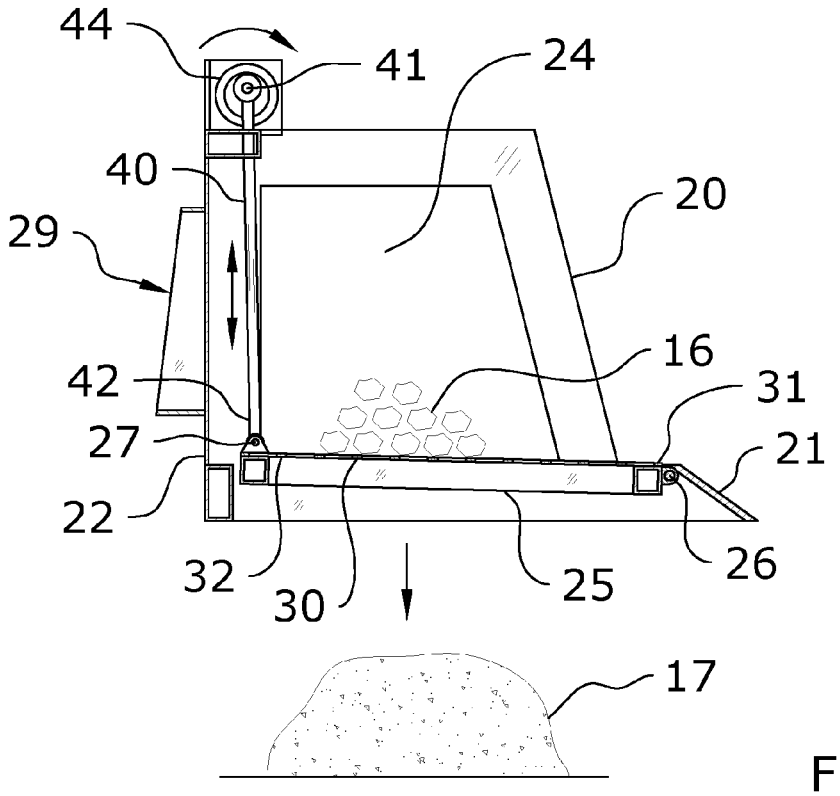
FIG. 12 is a side sectional view of the present invention in use.

To filter any debris 16 out of the materials 17, the motor 44 may be activated to begin reciprocating the lift rod 40 as shown in FIGS. 11 and 12. As the motor 44 turns, the lift rod 40 is rapidly raised and lowered in rapid succession, causing the screen 30 to raise and lower with the floor 25 to which the lift rod 40 is connected. As the floor 25 and screen 30 are raised and lowered, any materials 17 will fall through the screen 30 while debris 16 is retained on the screen 30.

Depending on the material 17 being screened, the operator can tilt the bucket 20 back or forward to change the angle of the screen 30 or spread the material 17 and debris 16 across the screen 30 to sift the material 17 quicker or bunch it up in the back of the bucket 20 to break up clumps of material 16 by beating the clumps together. The action of the screen 30 may be sped up or slowed down by various means depending on how the motor is controlled and the type of loader used. Large, heavy loads may need a faster action while smaller or more fragile materials 16 loads could need a slower action. The bucket 20 may then be moved to another location and the debris 16 dumped out. At this point, additional screening may be accomplished with the same screen 30, or a separate screen 30 may be interchanged to filter different materials 17 or debris 16.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A screening bucket system, comprising:

a bucket comprising a rear wall, a first side wall, and a second side wall;

a floor comprising a frame of elongated members, wherein the frame comprises a front end, a rear end, a first side, and a second side, wherein the frame of elongated members comprises at least one opening, wherein the rear end, first side, and second side of the frame of elongated members are not connected to the bucket;

a hinge connected between the first side wall and the second side wall, wherein the front end of the frame of elongated members is connected to the hinge;

a screen connected to the frame of elongated members;

a lift rod connected to the rear end of the frame of elongated members; and a motor for reciprocating the lift rod, wherein an upper end of the lift rod is connected to the motor and a lower end of the lift rod is connected to the frame of elongated members, wherein reciprocation of the lift rod is operable to rapidly raise and lower the frame of elongated members with respect to the bucket.

2. The screening bucket system of claim 1, wherein the hinge is connected near a front end of the bucket.

3. The screening bucket system of claim 2, wherein the lift rod is connected near a rear end of the bucket.

4. The screening bucket system of claim 1, wherein the screen is removably connected to the floor.

5. The screening bucket system of claim 1, wherein the screen is fixedly attached to the floor.

6. The screening bucket system of claim 1, wherein the motor comprises a hydraulic motor.

7. The screening bucket system of claim 1, wherein the lift rod is comprised of a metallic material.

8. The screening bucket system of claim 1, wherein the floor includes a rod mount, wherein the lower end of the lift rod is pivotally connected to the rod mount.

9. A screening bucket system, comprising:

a bucket comprising a rear wall, a first side wall, and a second side wall;

a hinge connected between the first side wall and the second side wall, wherein the hinge fully extends between the first side wall and the second side wall of the bucket;

a floor comprising a frame of elongated members having a front end, a rear end, a first side, a second side, and at least one opening, wherein the rear end, the first side, and the second side of the floor are not connected to the bucket, wherein the front end of the floor is connected to the hinge;

a screen connected to the floor;

a material positioned on the screen, wherein the material includes debris;

a lift rod comprising an upper end and a lower end, wherein the lower end of the lift rod is connected to the floor; and a motor for reciprocating the lift rod, wherein the upper end of the lift rod is connected to the motor, wherein reciprocation of the lift rod is operable to rapidly raise and lower the floor with respect to the bucket such that the debris falls through the screen and the at least one opening of the floor to exit the bucket.

10. The screening bucket system of claim 9, wherein the hinge is connected near a front end of the bucket.

11. The screening bucket system of claim 10, wherein the lift rod is connected near a rear end of the bucket.

12. The screening bucket system of claim 9, wherein the motor comprises an electric motor.

13. The screening bucket system of claim 9, wherein the screen is removably connected to the floor.

14. The screening bucket system of claim 13, further comprising a second screen, wherein the first screen and second screen are interchangeably connected to the floor.

15. The screening bucket system of claim 9, wherein the floor includes a rod mount, wherein the lower end of the lift rod is pivotally connected to the rod mount.

16. A screening bucket system, comprising:

a loader;

a bucket removably connected to the loader, the bucket comprising a rear wall, a first side wall, and a second side wall;

a hinge connected between the first side wall and the second side wall, wherein the hinge fully extends between the first side wall and the second side wall of the bucket;

a floor comprising a frame of elongated members having a front end, a rear end, a first side, a second side, and at least one opening, wherein the rear end, the first side, and the second side of the floor are not connected to the bucket, wherein the rear end, the first side, and the second side of the floor are movable with respect to the bucket, wherein the rear end of the floor extends alongside the rear wall of the bucket, wherein the first side of the floor extends alongside the first side wall of the bucket, wherein the second side of the floor extends alongside the second side wall of the bucket, wherein the front end of the floor is connected to the hinge;

a screen connected to the floor;

a material positioned on the screen, wherein the material includes debris;

a lift rod comprising an upper end and a lower end, wherein the lower end of the lift rod is connected to the floor; and a motor for reciprocating the lift rod, wherein the upper end of the lift rod is connected to the motor, wherein reciprocation of the lift rod is operable to rapidly raise and lower the floor with respect to the bucket such that debris falls through the screen and the at least one opening of the floor to exit the bucket.

17. The screening bucket system of claim 16, wherein the floor includes a rod mount, wherein the lower end of the lift rod is pivotally connected to the rod mount.

18. The screening bucket system of claim 16, wherein the screen is removably connected to the floor.

* * * * *